US007528741B2

(12) United States Patent
Gebert

(10) Patent No.: US 7,528,741 B2
(45) Date of Patent: May 5, 2009

(54) METHOD AND SYSTEM FOR VERIFYING A TRAFFIC VIOLATION IMAGE

(75) Inventor: Rudiger Heinz Gebert, Centurion (ZA)

(73) Assignee: Hi-Scan Technology (Pty) Ltd (ZA)

( * ) Notice: Subject to any disclaimer, the term of this patent is extended or adjusted under 35 U.S.C. 154(b) by 374 days.

(21) Appl. No.: 10/598,121

(22) PCT Filed: Feb. 18, 2005

(86) PCT No.: PCT/ZA2005/000042

§ 371 (c)(1),
(2), (4) Date: Oct. 23, 2006

(87) PCT Pub. No.: WO2005/091243

PCT Pub. Date: Sep. 29, 2005

(65) Prior Publication Data

US 2007/0247334 A1 Oct. 25, 2007

(30) Foreign Application Priority Data

Feb. 18, 2004 (ZA) ..... 04/1295

(51) Int. Cl.
*G08G 1/017* (2006.01)

(52) U.S. Cl. ..... 340/937; 340/933; 340/936; 701/119; 348/149

(58) Field of Classification Search ..... 340/933, 340/936, 937; 701/117, 119; 348/148, 149
See application file for complete search history.

(56) References Cited

U.S. PATENT DOCUMENTS

| | | | | |
|---|---|---|---|---|
| 5,935,190 | A * | 8/1999 | Davis et al. | 701/119 |
| 2002/0186297 | A1 | 12/2002 | Blakewell | |
| 2004/0222904 | A1 * | 11/2004 | Ciolli | 340/937 |
| 2004/0252193 | A1 * | 12/2004 | Higgins | 348/149 |

* cited by examiner

*Primary Examiner*—Toan N Pham
*Assistant Examiner*—Kerri L McNally
(74) *Attorney, Agent, or Firm*—Hahn and Moodley LLP; Vani Moodley

(57) ABSTRACT

A method 10 of verifying a traffic violation image and includes the step of automatically sensing 12 whether or not a vehicle commits a traffic violation, the step of automatically capturing 14 an image which shows a vehicle committing a traffic violation if it is sensed 12 that the vehicle has committed a traffic violation, the step of obtaining 16 verification data which verifies that the step of sensing 12 is accurate within acceptable limits, and the step of automatically combining 18 the obtained verification data with the captured traffic violation image to provide proof of the accurate sensing of the traffic violation. Also provided is an associated system.

20 Claims, 2 Drawing Sheets

METHOD AND SYSTEM FOR VERIFYING A TRAFFIC VIOLATION IMAGE

This is a National Phase of International Application PCT/ZA/2005/000042 filed Feb. 18, 2005, which claims priority to South African Patent Application ZA 2004/1295 filed Feb. 18, 2004.

FIELD OF THE INVENTION

This invention relates to a method and associated system for verifying a traffic violation image.

BACKGROUND TO THE INVENTION

Traffic offences may be repudiated in a court of law. The accuracy of the equipment used to capture a traffic violation is often questioned in these cases. The following invention seeks to provide more concrete proof that a traffic violation took place.

SUMMARY OF THE INVENTION

According to one aspect of the invention there is provided a method of verifying a traffic violation image which method includes the following steps, in any order:

- automatically sensing whether or not a vehicle commits a traffic violation;
- automatically capturing an image which shows the vehicle committing a traffic violation if it is sensed that the vehicle has committed a traffic violation;
- obtaining verification data which verifies that the step of sensing is accurate within acceptable limits; and
- automatically combining the obtained verification data with the captured traffic violation image to provide proof of the accurate sensing of the traffic violation.

It is to be appreciated that the method facilitates the traceability of calibration to a national or international measuring standard for traffic violation detection equipment used to sense and capture traffic violations, e.g. speed limit infringements, non-compliance with traffic signs, and/or the like. This traceability of calibration enables the tracing of the calibration details of the specific traffic violation detection equipment to establish that the violations recorded by the equipment are indeed accurate and irrefutable. This establishing of accuracy for traffic violations has direct application in a court of law when the validity of recorded traffic violations is disputed.

The step of sensing may include measuring the speed of a vehicle traveling along a road. The step of sensing may include sensing whether a vehicle disobeys a traffic indicator, e.g. a red light, or the like.

The step of capturing the traffic violation image may include photographically capturing the image on film. The step of capturing the traffic violation image may include capturing the image in digital format. The captured traffic violation image may be digitally encrypted. The captured traffic violation image may be digitally signed.

The step of obtaining the verification data may include obtaining first calibration data which verifies the calibration history of equipment used to sense the traffic violation and/or second calibration data which verifies the calibration history of equipment used to capture the traffic violation image. The first and/or second calibration data may be obtained from an engineer. The step of obtaining the first and/or second calibration data may include retrieving the calibration data from an electronic storage means. The first and/or second calibration data stored in the storage means may be periodically updated by an engineer. The first and/or second calibration data may be automatically generated by suitably configured calibration equipment. The first and/or second calibration data may include any set of operations, performed in accordance with a definite, documented procedure that compares the measurements performed by an instrument to those made by a more accurate instrument or standard, for the purpose of detecting and reporting, or eliminating by adjustment, errors in the instrument tested. The first and/or second calibration data may include validation by means of a digital signature.

It is to be appreciated that the equipment used to sense the traffic violation includes any suitable sensor, and the equipment used to capture the image generally includes a camera. Accordingly, the step of obtaining the verification data may include obtaining operational parameters of the sensor and/or camera used to capture the traffic violation image. The operational parameters may include ambient conditions of the sensor and/or camera used to capture the traffic violation image, such as temperature, humidity, light intensity, and/or similar environmental conditions. The operational parameters may include operating levels of components comprising the sensor and/or camera used to capture the traffic violation image, e.g. voltage levels, current levels, and/or the like. The operational parameters may include the geographic location where the image is captured. The geographic location may be specified by an engineer installing the sensor and/or camera used to capture the traffic violation image. The geographic location may be supplied by a Global Positioning System (GPS). The operational parameters may include a unique identifying number of an engineer who installed the sensor and/or camera used to capture the traffic violation image. The operational parameters may include identification numbers of components comprising the sensor and/or camera used to capture the traffic violation image.

The operational parameters may include a preprogrammed speed limit which, when exceeded by a vehicle sensed by the sensor, triggers the step of capturing the traffic violation image. The operational parameters may include a grace time period before the step of capturing is triggered by the step of sensing, e.g. the grace time period afforded a motorist after an intersection light has changed before a traffic camera will record if the motorist fails to stop at the intersection. The operational parameters may represent real-time values, typically obtained at the same time that the image is captured. Accordingly, the operational parameters typically include the time and date when the violation image is captured.

The step of obtaining the verification data and the step of capturing the traffic violation image may be performed simultaneously.

The step of combining the verification data with the traffic violation image may include imposing the verification data onto the traffic violation image. The step of combining the verification data may include digitally signing and encrypting the verification data together with a digital violation image. The step of combining the verification data with the traffic violation image may include printing the verification data onto the traffic violation image.

The method may further include the step of storing the verified image on a suitably configured storage means.

The method may include the step of transmitting the verified image to a remote location.

According to a second aspect of the invention there is provided a system for verifying a traffic violation image which system includes:

- A sensor for automatically sensing whether or not a vehicle commits a traffic violation;

a camera arranged in communication with the sensor which camera is configured to automatically capture an image of a vehicle committing a traffic violation if it is sensed that the vehicle has committed a traffic violation; and a processor arranged in communication with the camera which processor is configured to obtain verification data which verifies that the sensor senses accurately within acceptable limits, and to combine the obtained verification data with the captured traffic violation image to provide proof of the accurate sensing of the traffic violation.

The sensor is generally configured to sense whether a vehicle commits a traffic violation, such as, for example exceeding a speed limit, disobeying a road sign, or the like, and may include radar detection, laser detection, an inductive loop, a mechanical switch, an electromechanical switch, piezo-electric sensors, fibre optic sensors, or the like.

The camera may be a digital camera, i.e. a camera which captures images in electronic format. The camera may capture images on photographic film. The traffic violation image may be stored in digital format. The traffic violation image may be digitally signed. The traffic violation image may be digitally encrypted.

The verification data may include first calibration data for verifying the calibration history of the sensor and/or second calibration data for verifying the calibration history of the camera.

The system may include a storage means for storing the first and/or second calibration data. Accordingly, the processor may obtain the calibration data from the storage means. The first and/or second calibration data stored in the storage means may be periodically updated by an engineer. The first and/or second calibration data may include any set of operations, performed in accordance with a definite, documented procedure that compares the measurements performed by an instrument to those made by a more accurate instrument or standard, for the purpose of detecting and reporting, or eliminating by adjustment, errors in the instrument tested. The first and/or second calibration data may include validation by means of a digital signature.

The processor may obtain verification data by obtaining operational parameters of the sensor and/or camera used to capture the traffic violation image. The operational parameters may include ambient conditions of the sensor and/or camera used to capture the traffic violation image, such as temperature, humidity, light intensity, and/or similar environmental conditions. The operational parameters may include operating levels of components comprising the sensor and/or camera used to capture the traffic violation image, e.g. voltage levels, current levels, and/or the like. The operational parameters may include the geographic location where the image is captured. The geographic location may be specified by an engineer installing the sensor and/or camera used to capture the traffic violation image. The geographic location may be supplied by a Global Positioning System (GPS). The operational parameters may include a unique identifying number of an engineer who installed the sensor and/or camera used to capture the traffic violation image. The operational parameters may include identification numbers of components comprising the sensor and/or camera used to capture the traffic violation image.

The operational parameters may include a preprogrammed speed limit which, when exceeded by a vehicle sensed by the sensor, triggers the camera which captures the traffic violation image. The operational parameters may include a grace time period before the camera is triggered by the sensor. The processor may obtain the operational parameters as real-time values, typically obtained at the same time that the image is captured. Accordingly, the operational parameters typically include the time and date when the violation image is captured.

The processor may obtain the verification data at the same time that the camera captures the traffic violation image.

The processor may combine the verification data with the traffic violation image by imposing the verification data onto the traffic violation image. The processor may combine the verification data with the image by digitally signing and encrypting the verification data together with the violation image. The processor may combine the verification data with the traffic violation image by facilitating the printing of the verification data onto the traffic violation image. Accordingly, the system may include a printing means for printing the violation image and the verification data onto a suitable surface.

The processor may store the verified violation image on the storage means. The processor may transmit the verified violation image to a remote location.

BRIEF DESCRIPTION OF THE DRAWINGS

The invention is now described, by way of non-limiting example, with reference to the accompanying drawings wherein.

DETAILED DESCRIPTION OF THE INVENTION

Figure 1:
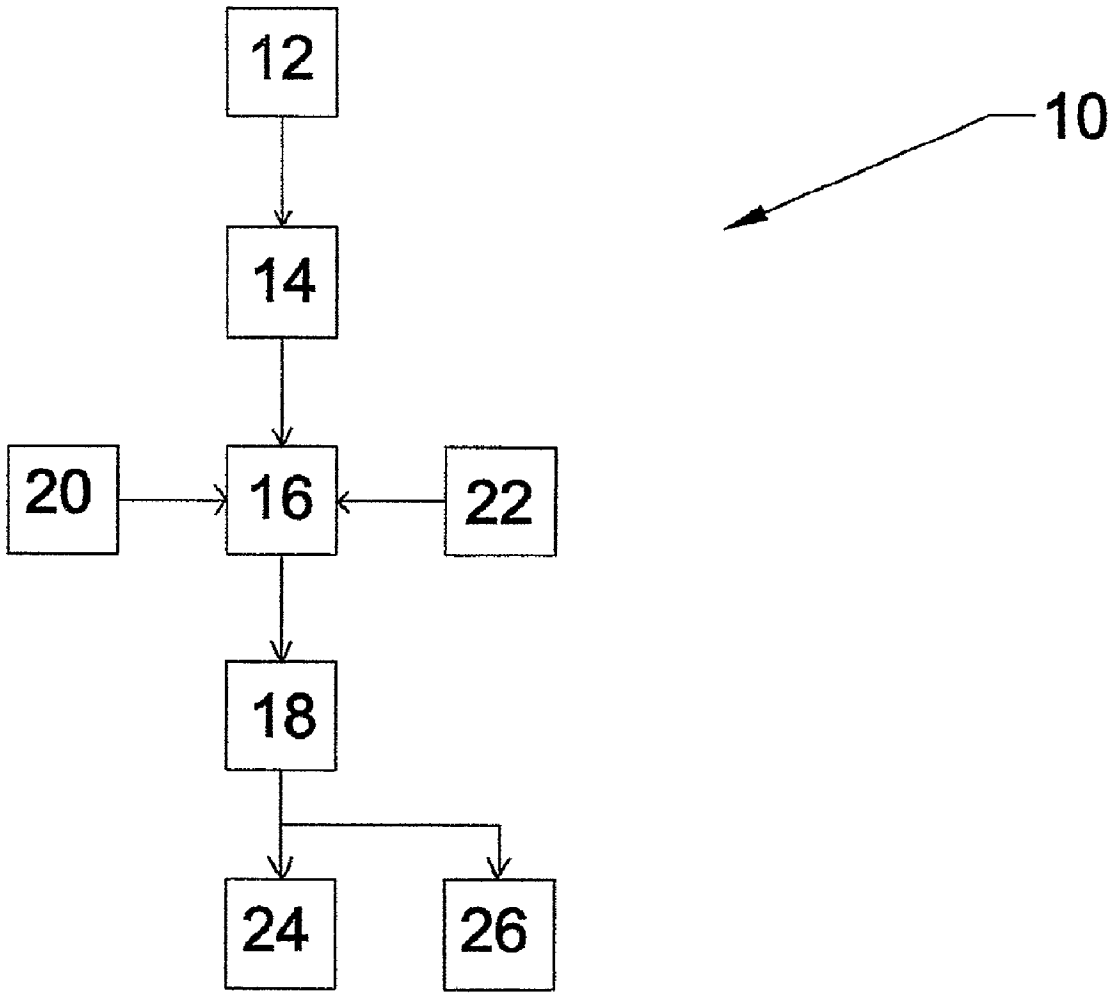
FIG. 1 shows a schematic diagram of a method of verifying a traffic violation image, in accordance with the invention.
Figure 2:
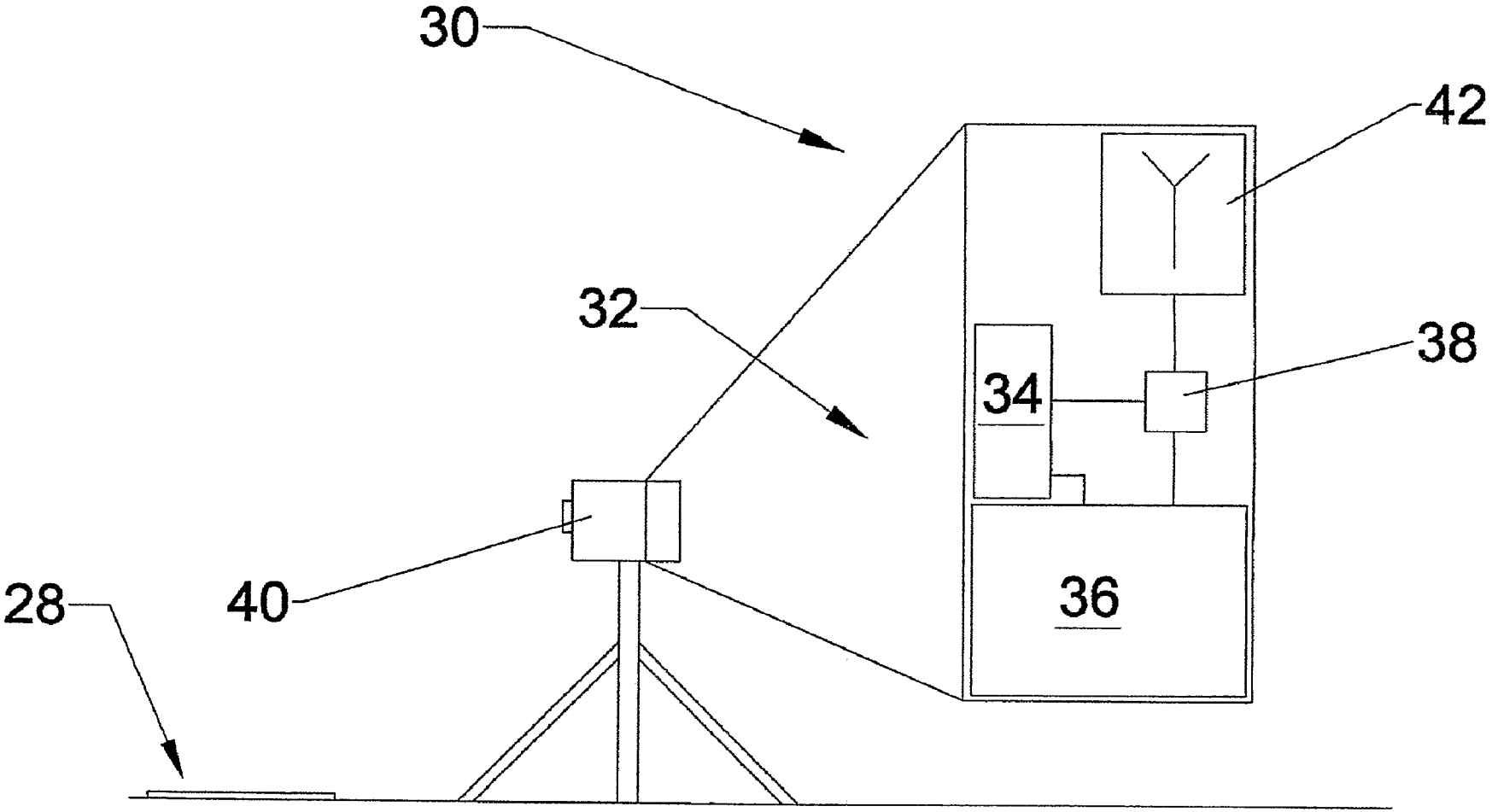
FIG. 2 shows a schematic representation of a system for verifying a traffic violation image, in accordance with the invention.

With reference to the accompanying drawings, a method of verifying a traffic violation image, in accordance with the invention, is generally indicated by reference numeral 10, and a system for verifying a traffic violation image, in accordance with the invention, is generally indicated by reference numeral 30.

The method 10 of verifying a traffic violation image includes the steps of automatically sensing 12 whether or not a vehicle commits a traffic violation, automatically capturing 14 an image which shows a vehicle committing a traffic violation if it is sensed 12 that the vehicle has committed a traffic violation, obtaining 16 verification data which verifies that the step of sensing 12 is accurate within acceptable limits; and automatically combining 18 the obtained verification data with the captured traffic violation image to provide proof of the accurate sensing of the traffic violation.

The step of sensing 12 typically comprises measuring the speed of a vehicle traveling along a road, but may also include sensing 12 whether a vehicle disobeys a traffic indicator, e.g. a red light, or the like. The step of sensing 12 is performed by sensor 28 which automatically senses 12 whether or not a vehicle commits a traffic violation. The sensor 28 includes any sensor configured to sense 12 whether or not a vehicle commits a traffic violation, and includes radar detection, laser detection, a mechanical switch, a hydraulic switch, a pneumatic switch, an electromechanical switch, or the like. In this embodiment of the invention, the sensor 28 is presented in the form of a piezo-electric sensor 28.

The step of capturing 14 the traffic violation image is achieved by capturing 14 the image in digital format. It is to be appreciated that, in other embodiments, the image may be photographically captured on film. The captured traffic violation image is typically digitally signed and encrypted. In this embodiment of the invention, a digital camera 40 captures the image in electronic format. It is to be appreciated that the camera only captures the image when the camera 40 is triggered by the sensor 28.

The step of obtaining 16 the verification data includes obtaining 16 calibration data 20 and operational parameters 22 of the sensor 28 and camera 40. It is to be appreciated that the calibration data 20 verifies the calibration history of the sensor 28 and the camera 40. Accordingly, in this specification, first calibration data refers to the calibration data used to verify the calibration history of the sensor 28, and second calibration data refers to calibration data used to verify the calibration history of the camera 40. In general, calibration data refers to the first and/or second calibration data. The calibration data may be retrieved from a storage means 34. The calibration data 20 stored in the storage means 34 is generally periodically updated by an engineer who calibrates the sensor 28 and camera 40. The calibration data 20 is typically validated by means of a digital signature. The calibration data may include any set of operations, performed in accordance with a definite, documented procedure that compares the measurements performed by an instrument to those made by a more accurate instrument or standard, for the purpose of detecting and reporting, or eliminating by adjustment, errors in the instrument tested.

In this embodiment of the invention, the operational parameters 22 typically include ambient conditions of the sensor 28 and camera 40 used to capture the traffic violation image, such as temperature, humidity, light intensity, and/or similar environmental conditions. The operational parameters 22 further include operating levels of the individual components comprising the sensor 28 and camera 40 used to capture the traffic violation image, e.g. voltage levels, current levels, and the like. The operational parameters 22 also include the geographic location where the image is captured. In this embodiment of the invention, the geographic location is programmed by an engineer installing the sensor 28 and camera 40. In other embodiments, the geographic location may be supplied by a Global Positioning System (GPS). The operational parameters further include a unique identifying number of the engineer who installed the sensor 28 and the camera 40. The operational parameters also include identification numbers of the individual components comprising the sensor 28 and the camera 40.

The operational parameters 22 generally also include a preprogrammed speed limit which, when exceeded by a vehicle sensed by the sensor 28, triggers the camera 40 to capture an image. The operational parameters 22 include a grace time period before the camera 40 is triggered by the sensor 28, e.g. the grace time period afforded a motorist after an intersection light has changed before a traffic camera will record if the motorist fails to stop at the intersection. In this embodiment, the operational parameters 22 represent real-time values, typically obtained at the same time that the image is captured.

In this embodiment of the invention, the processor 38 obtains 16 the operational parameters 22 through monitoring apparatus 36 arranged in communication with the processor 38, the storage means 34, the camera 40, and the sensor 40. It is to be appreciated that the monitoring apparatus facilitates the processor 38 obtaining 16 the operational parameters 22.

In this embodiment, the step of combining 18 the verification data with the traffic violation image is achieved by digitally imposing the verification data onto the traffic violation image. In other embodiments, the step of combining 18 the verification data may include digitally signing and encrypting the verification data together with a digital violation image, or the step of combining 18 may include printing the verification data onto the traffic violation image. The processor 38 digitally imposes the verification data onto the traffic violation image.

The processor 38 then stores the verified image on the storage means 34. In this embodiment, the method 10 includes the step of transmitting 26 the verified image to a remote location. Accordingly, the system 30 includes a transmitter 42 for transmitting 26 the verified image to a remote location.

For example, in one embodiment of the invention, if a traffic violation is committed, the sensor 28 triggers the camera 40 to capture an image of the violation which image typically shows a vehicle for identification purposes. The processor 38 then superimposes the digitally signed calibration data and the operational parameters 22 of the sensor 28 and camera 40 onto the image. This combining 18 of the verification data with the image accordingly provides a validated violation image which includes the time and date of the violation, the ambient conditions under which the violation took place, identifying numbers of the components used to capture the violation, location of the violation, digitally signed calibration data of the sensor 28 and camera 40 used to capture the violation, operating levels of the components used to capture the violation, details of the transgression, and an image of a transgressor. This is particularly useful for establishing irrefutable evidence against the transgressor in a court of law.

It is to be appreciated that, in this embodiment of the invention, the system 30 is integrated into the housing 32 of a traffic camera 40.

It shall be understood that the example is provided for illustrating the invention further and to assist a person skilled in the art with understanding the invention and is not meant to be construed as unduly limiting the reasonable scope of the invention.

The Inventor regards it as an advantage that the invention enables the establishment of traceability of calibration for equipment used in capturing traffic violations, thereby providing more concrete proof that a traffic transgression has taken place. The combining of the verification data into a traffic violation image makes the refuting of the violation by a transgressor much more difficult in a court of law.

The invention claimed is:

1. A system for verifying a traffic violation image, which system includes:

a sensor for automatically sensing whether or not a vehicle commits a traffic violation;

a camera arranged in communication with the sensor which camera is configured to automatically capture an image of a vehicle committing a traffic violation if it is sensed that the vehicle has committed a traffic violation; and a processor arranged in communication with the camera which processor configured to obtain calibration data which verifies a calibration history of the sensor and/or the camera in order to verify that the sensor and/or the camera senses accurately within acceptable limits, and to automatically incorporate the obtained calibration data into the captured traffic violation image to provide proof of the accurate sensing and/or capturing of the traffic violation.

2. The system as claimed in claim 1, wherein the processor is configured to obtain the calibration data by comparing operational parameters of the camera and/or sensor to a standard or measurements made by a more accurate instrument for the purpose of detecting, reporting, and eliminating by adjustment any errors in the sensor and/or camera tested.

3. The system as claimed in claim 2, wherein the operational parameters include ambient conditions of the system.

4. The system as claimed in claim 2, wherein the operational parameters include operating levels of components comprising the system.

5. The system as claimed in claim 2, wherein the operational parameters include a unique identifying number of an engineer who installed the system.

6. The system as claimed in claim 2, wherein the operational parameters include identification numbers of components comprising the system.

7. The system as claimed in claim 2, wherein the operational parameters include a preprogrammed speed limit which, when exceeded by a vehicle sensed by the sensor, triggers the camera which captures the traffic violation image.

8. The system as claimed in claim 2, wherein tie operational parameters include a grace time period before the camera is triggered by the sensor.

9. The system as claimed in claim 2, wherein the processor obtains the operational parameters as real-time values.

10. The system as claimed in claim 2, wherein the operational parameters include a geographic location where the image is captured.

11. The system as claimed in claim 10, wherein the geographic location is supplied by a Global Positioning System (GPS).

12. The system as claimed in claim 1, wherein the processor obtains the calibration data at the same time that the camera captures the traffic violation image.

13. The system as claimed in claim 1, wherein the processor incorporates the calibration data with the image by digitally signing and encrypting the calibration data together with the violation image.

14. The system as claimed in claim 1, wherein the processor facilitates the transmission of the verified violation image to a remote location.

15. A method of verifying a traffic violation image which method includes the following steps automatically sensing whether or not a vehicle commits a traffic violation;

automatically capturing an image which shows the vehicle committing a traffic violation if it is sensed that the vehicle has committed a traffic violation;

obtaining calibration data which verifies a calibration history of equipment used to sense and/or capture the traffic violation in order to verify that the steps of sensing and/or capturing are accurate within acceptable limits; and automatically incorporating the obtained calibration data into the captured traffic violation image to provide proof of the accurate sensing and/or capturing of the traffic violation.

16. The method as claimed in claim 15, wherein the calibration data is obtained by comparing operational parameters of the equipment to a standard or measurements made by a more accurate instrument for the purpose of detecting, reporting, and eliminating by adjustment any errors in the equipment tested.

17. The method as claimed in claim 16, wherein the operational parameters include ambient conditions of the equipment.

18. The method as claimed in claim 16, wherein the operational parameters include operating levels of components comprising the equipment.

19. The method as claimed in claim 16, wherein the operational parameters represent real-time values obtained at the same time that the image is captured.

20. The method as claimed in claim 15, wherein the step of incorporating the calibration data includes digitally signing and encrypting the calibration data together with a digital violation image.

* * * * *